US011882874B2

(12) United States Patent
King

(10) Patent No.: US 11,882,874 B2
(45) Date of Patent: Jan. 30, 2024

(54) SMOKING PIPES AND RELATED METHODS

(71) Applicant: Royal Oak Cannabis Products Ltd., Niagara Falls (CA)

(72) Inventor: Brent King, Niagara Falls (CA)

(73) Assignee: Royal Oak Cannabis Products Ltd., Niagara Falls (CA)

( * ) Notice: Subject to any disclaimer, the term of this patent is extended or adjusted under 35 U.S.C. 154(b) by 411 days.

(21) Appl. No.: 16/450,227

(22) Filed: Jun. 24, 2019

(65) Prior Publication Data

US 2020/0397041 A1 Dec. 24, 2020

(51) Int. Cl.

| | |
|---|---|
| ***A24F 1/10*** | (2006.01) |
| ***A24F 1/00*** | (2006.01) |
| ***A24F 1/32*** | (2006.01) |
| ***A24F 1/28*** | (2006.01) |

(52) U.S. Cl.

CPC ..... *A24F 1/32* (2013.01); *A24F 1/00* (2013.01); *A24F 1/28* (2013.01); *A24F 1/10* (2013.01)

(58) Field of Classification Search

None

See application file for complete search history.

(56) References Cited

U.S. PATENT DOCUMENTS 549,418 A * 11/1895 Woodward ..... A24F 1/00 106/701
1,021,963 A * 4/1912 Ansley ..... A24F 1/24 131/180
1,434,119 A 10/1922 Hirschl et al.
1,943,907 A * 1/1934 Watry ..... A24F 1/00 131/211
4,058,130 A * 11/1977 Curtiss ..... A24F 1/00 131/194

(Continued)

FOREIGN PATENT DOCUMENTS

GB 21830 * 9/1910 ..... A24F 5/00
GB 1213317 A 11/1970

OTHER PUBLICATIONS

CA Office Action dated Sep. 13, 2019, CA Application No. 3,047,886.

(Continued)

*Primary Examiner* — Philip Y Louie
*Assistant Examiner* — Sonny V Nguyen
(74) *Attorney, Agent, or Firm* — Rowand LLP

(57) ABSTRACT

A smoking pipe includes a bowl defining an interior chamber for holding a quantity of combustible substance. The bowl has an upper opening and optional lower opening. A stem extends from the bowl to define an interior airway with an opening proximate a distal end of the stem. The optional lower opening and interior airway are in gaseous communication with the interior chamber of the bowl. An example pipe has its bowl shaped to allow the pipe to be received in a bowl-stem of a waterpipe with the interior chamber of the bowl in gaseous communication with an airway of the bowl-stem via the lower opening of the bowl. Another example pipe has its upper and stem openings sealed to maintain freshness of pre-loaded cannabis. The pipe may be made of corncob and may be disposable. More broadly, a vessel for both storage of cannabis and consumption thereof is disclosed.

17 Claims, 8 Drawing Sheets

(56) References Cited

U.S. PATENT DOCUMENTS

| | | | | |
|---|---|---|---|---|
| 4,294,267 | A * | 10/1981 | Glymph | A24F 1/00 131/179 |
| 2012/0060555 | A1* | 3/2012 | Parris | A24F 1/00 63/1.11 |
| 2016/0037825 | A1* | 2/2016 | Stein | A24F 1/30 131/328 |
| 2016/0157520 | A1* | 6/2016 | Alfawaz | A24F 5/00 131/173 |
| 2016/0183589 | A1* | 6/2016 | Born | A24F 1/32 131/191 |
| 2017/0251720 | A1* | 9/2017 | Heidenreich | A24F 1/28 |
| 2018/0256835 | A1* | 9/2018 | Fornarelli | A61M 11/042 |
| 2019/0300265 | A1* | 10/2019 | Freitekh | B65D 81/28 |
| 2020/0253264 | A1* | 8/2020 | Rousseau | A24B 15/16 |

OTHER PUBLICATIONS

CA Office Action dated Jul. 10, 2020 relating to CA Application No. 3,047,886.

Anukam et al.: Research Article "Studies on Characterization of Corn Cob for Applications in a Gasification Process for Energy Production", published in Hindawi, Journal of Chemistry, vol. 2017, Article ID 6478389, 9 pages, https://doi.org/10.1155/2017/6478389.

Cernich: "After 147 Years, Washington Remains the 'Corn Cob Pipe Capital of the World", Published by emissourian.com, Oct. 19, 2016; http://www.emissourian.com/features_people/feature_stories/after-years- washington-remains-the-com-cob-pipe-capital-of/article_695d8bc8-9602-11e6-999b-9b2773876dcb.html.

Fehr et al.: "Analysis of Cannabis Smoke Obtained under Different Combustion Conditions", Canadian Journal of Physiology and Pharmacology, 1972, 50(8): 761-767; Available from https://www.nrcresearchpress.com/doi/10.1139/y72-111.

Tsoumis et al.: "Characteristics of Briarwood", Department of Forestry and Natural Environment, Holzforschung, vol. 42 (1988) No. 2, 71-77.

Online Forum: "Fair Trade Tobacco—How to grow, cure and process tobacco", retrieved from https://fairtradetobacco.com/threads/diy-corn-cob-pipe.7073/ on Jan. 16, 2019.

Big Daddy Smoke: "Helpful Guide to Buying Bong Bowl—Types, Sizes and More", retrieved from https://bigdaddysmoke.com/helpful-guide-buying-bong-bowl/ on Jan. 16, 2019.

The Art of Manliness Forum: "How to Make a Corn Cob Pipe", Last updated: Nov. 3, 2018, retrieved from https://www.artofmanliness.com/articles/how-to-make-a-corn-cob-pipe/ on Jan. 16, 2019.

The Hot Box Magazine: "Know Your Bowl or Nail Size in Seconds", retrieved from https://thehotboxmagazine.com/know-bowl-size/ on Jan. 16, 2019.

The Right Pipe: "Missouri Meerschaum Biography" retrieved from http://www.therightpipe.com/Missouri- Meerschaum-Biography-c503.html on Jan. 16, 2019.

* cited by examiner

SMOKING PIPES AND RELATED METHODS

FIELD

This relates to smoking accessories and, more particularly, smoking pipes and related methods.

BACKGROUND

Pipe smoking is the practice of tasting or inhaling smoke produced by burning a substance in a pipe. Pipe smoking is the oldest known traditional form of smoking, having been used in North American indigenous cultures before the arrival of Europeans. In various parts of the world the use of pipes for smoking tobacco and cannabis, among other things, has also long been prevalent.

DESCRIPTION OF THE DRAWINGS

Embodiments are described in detail below, with reference to the following drawings.

Like reference numerals are used in the drawings to denote like elements and features.

DETAILED DESCRIPTION

Figure 1:
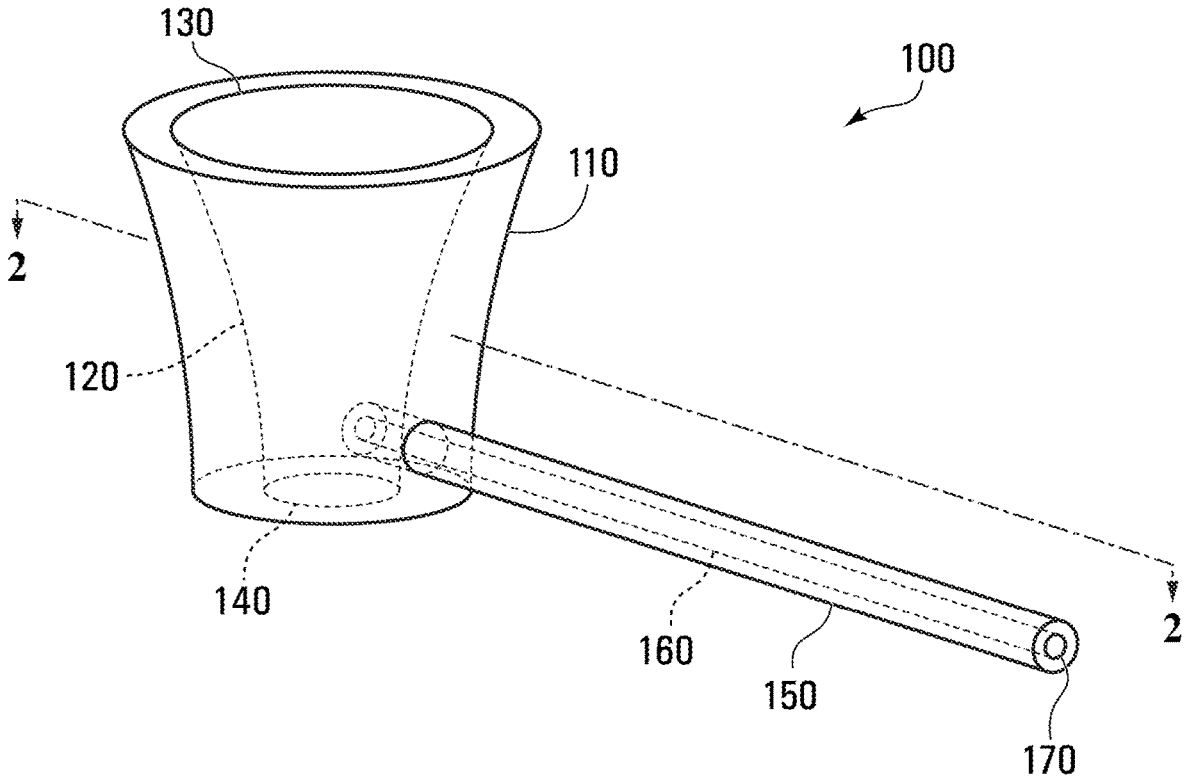
FIG. 1 is a perspective view of a smoking pipe according to the subject matter of the present application.

According to the subject matter of the present application, there may be provided a pipe including a bowl and a stem. The bowl may define an interior chamber with an upper opening and a lower opening. The interior chamber may be in gaseous communication with the lower opening. The stem may extend from the bowl. The stem may define an interior airway with an opening proximate a distal end of the stem. The interior airway may be in gaseous communication with the interior chamber of the bowl. It may be that the bowl is shaped to allow the pipe be received in a bowl-stem of a waterpipe. The interior chamber of the bowl may be in gaseous communication with an airway of the bowl-stem via the lower opening of the bowl.

In this way, a pipe may provided that is capable of use as a bowl of a waterpipe. Notably, where the pipe is formed of low-cost materials, it may be discarded after use, allowing cleaning of a pipe and/or waterpipe bowl to be avoided.

It may be that the pipe bowl is sized to be received in a 10-millimetre bowl-stem fitting, a 14-millimetre bowl-stem fitting, and/or an 18-millimetre bowl-stem fitting. Additionally or alternatively, it may be that the bowl is substantially frustoconical in profile. Additionally or alternatively, it may be that an exterior sidewall of the bowl is tapered to allow the bowl to be received in a tapered bowl-stem.

In some implementations, the bowl extends between the upper opening and the lower opening.

It may be that the pipe is for use with cannabis and that a cross-sectional area of the lower opening is selected to limit escape of at least one of ground cannabis or cannabis ash through the lower opening.

In some implementations, the interior chamber is in gaseous communication with the lower opening via a shaft extending therebetween.

It may be that the pipe is for use with cannabis and that a cross-sectional area of an opening of the shaft proximate the bowl is sized to limit entry of at least one of ground cannabis and/or cannabis ash into the shaft.

In some implementations, the pipe may include at least one screen disposed proximate at least one of the lower opening and an opening of the shaft proximate the bowl to limit escape of at least one of ground cannabis or cannabis ash through the lower opening.

It may be that a cross-sectional area of the upper opening is greater than a cross-sectional area of the lower opening.

Conveniently, such a screen and/or such a relative sizing of openings may allow escape of cannabis or cannabis ash from the pipe to be prevented and/or limited.

In some implementations, the bowl may be formed of corncob.

In some implementations, the stem may be formed of wood.

In some implementations, at least one of the bowl and the stem may be formed of briarwood.

In some implementations, the pipe may include sealing elements occluding one or more of the lower opening of the bowl, the upper opening of the bowl, and the opening of the stem.

In some implementations, the pipe may be pre-loaded with cannabis. For example, the cannabis may be ground cannabis. It may be that the cannabis weighs between about 0.25 and 0.5 grams. For example, the cannabis may weigh about 0.5 grams. Additionally or alternatively, it may be that the cannabis has a delta-9-tetrahydrocannabinol (THC) concentration of not more than 0.3 percent on a dry weight basis.

In some implementations, the sealing elements may be removable seals. For example, the removable seals may be induction seals.

In some implementations, it may be that a sealing element occludes each of the lower opening of the bowl, the upper opening of the bowl, and the opening of the stem.

Notably, the freshness level of the substance being smoked is of great importance to users. As further described below, the pipe may be preloaded with some combustible substance such as, for example, cannabis. It may be the case that such combustible substances become stale when left exposed to air. Such degradation may, in turn, negatively impact the flavour experienced by the user when the substance is smoked in the pipe. Providing such sealing elements may prevent or limit such degradation such as, for example, prior to use of a preloaded pipe (e.g., during storage and/or transportation).

According to the subject matter of the present application, there may be provided a method of producing a pre-loaded cannabis pipe. The method may include: providing a pipe according to above; applying a sealing element to the lower opening of the bowl of the pipe; placing a quantity of cannabis in the bowl of the pipe; applying a sealing element to the upper opening of the bowl of the pipe; and applying a sealing element to the opening of the airway of the stem of the pipe.

In some instances, the method may further include injecting at least one gas other than oxygen into the interior of the pipe. It may be that the at least one gas other than oxygen includes nitrogen.

In some instances, it may be that the cannabis is ground cannabis.

In some instances, it may also be that the cannabis weighs between 0.25 and 0.5 grams. For example, it may be that the cannabis weighs about 0.5 grams. Additionally or alternatively, it may be that the cannabis has a delta-9 tetrahydrocannabinol (THC) concentration of not more than 0.3 percent on a dry weight basis.

In some instances, it may be that the sealing elements are removable seals.

In some implementations, it may be that the removable seals are induction seals.

According to the subject matter of the present application, there may be provided a method of producing a pre-loaded cannabis pipe. The method may include: providing a corncob pipe; drilling a shaft from a lower portion of a chamber of a bowl of the pipe and extending through a base of the bowl; applying a sealing element to a lower opening defined by the shaft in the base of the bowl; placing a quantity of cannabis in the bowl of the pipe; applying a sealing element to an upper opening defined by the chamber of the bowl; applying a sealing element to an opening of a stem of the pipe; and shaping the bowl of the pipe to allow the pipe to be received in a bowl-stem of a waterpipe with the bowl of the pipe in gaseous communication with an airway of the bowl-stem via the lower opening of the bowl.

Conveniently, in this way, a disposable pre-loaded cannabis pipe may be provided. This may provide users with a pipe that can be discarded after use, thus obviating the need to clean the pipe after smoking.

In some instances, the method may further include: prior to applying at least a last one of the sealing elements, substantially displacing oxygen from the interior of the pipe. For example, it may be that substantially displacing oxygen from the interior of the pipe includes injecting at least one gas other than oxygen into the interior of the pipe. In a particular example, the at least one gas other than oxygen may include nitrogen.

In some instances, it may be that the cannabis is ground cannabis.

In some instances, it may be that the cannabis weighs between 0.25 and 0.5 grams. For example, it may be that the cannabis weighs about 0.5 grams. Additionally or alternatively, it may be that the cannabis has a delta-9 tetrahydrocannabinol (THC) concentration of not more than 0.3 percent on a dry weight basis.

In some instances, the sealing elements may be removable seals. For example, the removable seals may be induction seals.

According to the subject matter of the present application, there may be provided a method of using a pipe according to the above (which may, in some implementations, be a pre-loaded cannabis pipe) with a waterpipe. The method may include: removing the sealing elements from the upper and lower openings of the bowl; placing the bowl in a bowl-stem of the waterpipe; and heating the cannabis.

In some instances, it may be that heating the cannabis includes heating the cannabis to ignition.

In some instances, it may be that the cannabis is heated by exposing it to a flame.

According to the subject matter of the present application, there may be provided a method of using a pipe according to the above (which may, in some implementations, be a pre-loaded cannabis pipe). The method may include: removing the sealing elements from the upper opening of the bowl and from the opening of the stem; and heating the cannabis.

In some instances, it may be that heating the cannabis includes heating the cannabis to ignition.

In some instances, it may be that the cannabis is heated by exposing it to a flame.

According to the subject matter of the present application, a pipe according to above (which may, in some implementations be a pre-loaded cannabis pipe) may be used.

According to the subject matter of the present application, there may be provided a pre-loaded cannabis pipe. The pipe may include a bowl and a stem. The bowl may define an interior chamber with an upper opening. The stem may extend from the bowl. The stem may define an interior airway with an opening proximate a distal end of the stem. The interior airway may be in gaseous communication with the interior chamber of the bowl. A quantity of cannabis may be placed in the bowl of the pipe. A sealing element may occlude each of the upper opening of the bowl and the opening of the stem.

In some instances, the airway may be in gaseous communication with the interior chamber via a shaft extending therebetween.

In some instances, the bowl may be formed of corncob.

In some instances, the stem may be formed of wood.

In some instances, at least one of the bowl and the stem may be formed of briarwood.

In some instances, the cannabis may be a cannabis derivative.

In some instances, it may be that the cannabis is ground cannabis.

In some instances, the cannabis may weigh between 0.25 and 0.5 grams. For example, the cannabis may weigh about 0.5 grams. Additionally or alternatively, the cannabis may have a delta-9 tetrahydrocannabinol (THC) concentration of not more than 0.3 percent on a dry weight basis.

In some instances, the sealing elements may be removable seals. For example, the removable seals may be induction seals.

According to the subject matter of the present application, there may be provided a method of producing a pre-loaded cannabis pipe. The method may include: providing a pipe having a bowl and a stem extending from the bowl, the stem having an opening proximate a distal end of the stem; placing a quantity of cannabis in the bowl of the pipe; applying a sealing element to an upper opening of the bowl of the pipe; and applying a sealing element to the opening of the stem of the pipe.

In some instances, the method may further include injecting at least one gas other than oxygen into the interior of the pipe. For example, the at least one gas other than oxygen may include nitrogen.

In some instances, the cannabis may be a cannabis derivative.

In some instances, the cannabis may be ground cannabis.

In some instances, the cannabis may weigh between 0.25 and 0.5 grams of cannabis. For example, the cannabis may weigh about 0.5 grams. Additionally or alternatively, the cannabis may have a delta-9 tetrahydrocannabinol (THC) concentration of not more than 0.3 percent on a dry weight basis.

In some instances, the sealing elements may be removable seals. For example, the removable seals may be induction seals.

It may be that the pipe is a corncob pipe.

According to the subject matter of the present application, there may be provided a method of using a pre-loaded cannabis pipe as discussed above. The method may include: removing the sealing elements from the upper opening of the bowl and from the opening of the stem; and heating the cannabis.

In some instances, heating the cannabis may include heating the cannabis to ignition.

In some instances, the cannabis may be heated by exposing the cannabis to a flame.

According to the subject matter of the present application, a pre-loaded cannabis pipe as discussed above may be used.

According to the subject matter of the present application, there may be provided a vessel including a body. The body may have one or more openings. The body may define an interior chamber. The one or more openings may be in communication with the interior chamber. A quantity of combustible material may be disposed within the body. The vessel may include one or more sealing elements sealing the one or more openings. At least one of the one or more sealing elements may be removable to place the vessel into a configuration where the vessel may be used to consume the quantity of combustible material via combustion.

In some instances, the combustible material may be cannabis. For example, the cannabis may be a cannabis derivate. In another example, the cannabis may be ground cannabis. It may be that the cannabis weights between 0.25 and 0.5 grams. For example, the cannabis may weigh about 0.5 grams. The cannabis may have a delta-9 tetrahydrocannabinol (THC) concentration of not more than 0.3 percent on a dry weight basis.

In some instances, the removable ones of the one or more sealing elements may be induction seals.

According to the subject matter of the present application, there may be provided a method of using a vessel according to the above. The method may include removing at least one of the removable ones of the one or more sealing elements from the vessel to place the vessel into a configuration where at least some of the openings are unobstructed and the vessel may be used to so consume the combustible material via combustion; and heating the combustible material. In some instances, heating the cannabis may include heating the combustible material to ignition. For example, the cannabis may be heated by exposing the combustible material to a flame.

According to the subject matter of the present application, a vessel as discussed above may be used.

Other aspects and features of the present application will be understood by those of ordinary skill in the art from a review of the following description in conjunction with the accompanying figures.

FIG. 1 shows a perspective view of a pipe 100. The pipe 100 is a smoking pipe and may be used for smoking. As illustrated, the pipe 100 includes a bowl 110 and a stem 150. The bowl 110 is for holding a quantity of combustible substance, such as, for example, tobacco or cannabis, so that the substance can be smoked by a user of the pipe 100. A user draws in smoke from the stem 150 when smoking the pipe 100.

The bowl 110 of the pipe 100 defines an interior chamber 120 (shown in stippled lines) having an upper opening 130 and lower opening 140. The bowl 110 may, as illustrated, extend between the upper opening 130 and the lower opening 140. By so extending, the interior chamber 120 may be in gaseous communication with the lower opening 140. Alternatively, and as further discussed below in relation to FIG. 4, the interior chamber 120 may be in gaseous communication with the lower opening 140 indirectly such as, for example, via a shaft extending therebetween.

The stem 150 of the pipe 100 may, as illustrated, extend from the bowl 110. The stem 150 may define an interior airway 160. The airway may have an opening 170. The opening 170 may be located on or near the furthest end of the stem 150 from the bowl 110—i.e., on or near a distal end of the stem 150. For example, the stem opening 170 may, as illustrated, be located on the distal end of the stem. The interior airway 160 may connect with the interior chamber 120 of the bowl 110 to provide a pathway for smoke to travel from combustible source to user. Put differently, the interior airway 160 may be in gaseous communication with the interior chamber 120.

As further described below, one or more portions of the pipe 100 may be shaped in such a way so as to make the pipe 100 compatible for use with a waterpipe. For example, it may be that the bowl 110 is shaped to be received a bowl-stem of a water pipe so as to place the interior chamber 120 of the bowl 110 in gaseous communication with an airway of the bowl-stem via the lower opening 140 of the bowl 110.

The pipe 100 may be formed of any number of suitable materials. Desirable characteristics of a suitable material may include fire/heat resistance, moisture absorption, and a lack of imparting flavour or odour to material being stored in/smoked using the pipe 100. Additionally or alternatively, a suitable material might be ones that, while it imparts a flavour or odour during combustion, that flavour is pleasant/complimentary to the material that will be smoked in the pipe 100. Examples of suitable materials for forming the pipe 100 may include briarwood, clay, ceramic, corncob, glass, meerschaum, metal, gourd, stone, wood, and/or combinations thereof.

In a particular example, it may be desirable to form the bowl 110 of the pipe 100 out of corncob. Notably, the thermal properties of corncob offer one or more benefits when used in forming the bowl 110. For example, experiment results suggest that complete thermal decomposition of corncob occurs at temperatures close to 1000° C.—well beyond the boiling/vaporization points of the different constituent compounds/terpenes of cannabis. Accordingly, a pipe 100 having a bowl formed of corncob may be suited for the smoking of cannabis. Furthermore, corncob has a well-deserved reputation for its lack of unpleasant effect on smoke when cannabis is combusted therein. For example, in some cases, combusting cannabis in a corncob pipe bowl may impart a complimentary "nutty" flavour to the smoke. Notably, corncob is inexpensive and bio-degradable. Accordingly, corncob may be employed in forming a pipe (e.g., a cannabis pipe) having a relatively low materials cost such, as for example, a pipe having a bowl formed of corncob and a stem formed of wood or a similar product (e.g., paper, cardboard or some other wood product). Notably, a cannabis pipe including a corncob bowl may—e.g., due to low-cost and/or biodegradability—treated as disposable, especially if the stem is also formed of a low-cost and/or biodegradable material such as, for example, wood or a similar product.

Notably, where the pipe 100 is disposable such as, for example, in the case where the pipe 100 is a disposable corncob pipe, cleaning of the pipe 100 may be avoided. In particular, a user may discard such a pipe once soiled (e.g., after one or more uses), thus avoiding the burden of cleaning and maintaining a pipe.

As mentioned above, the stem 150 may be formed of wood. More particularly, one or both of the bowl 110 and stem 150 may be formed out of one or more types of wood, such as, for example, pear-wood, rose-wood, cherry, olive, maple, mesquite, oak, bog-wood and/or briarwood. Notably, briarwood, in particular, may be used in forming pipes as it is extremely hard, dense, and heat-resistant, and does not generally affect the aroma of smoke.

Figure 2:
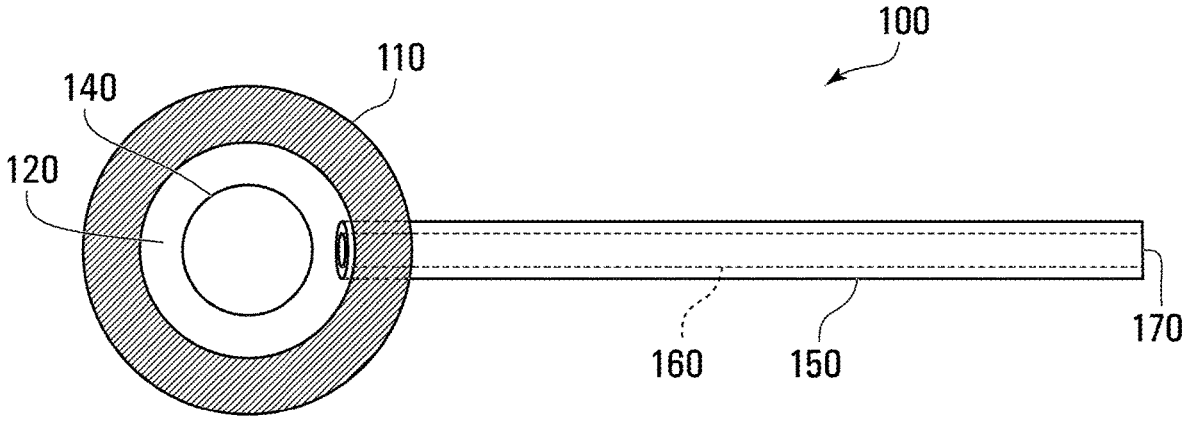
FIG. 2 is a cross-section view of the pipe in FIG. 1 taken along line 2-2 in FIG. 1.

FIG. 2 is a cross-section view of the pipe 100 taken along the line 2-2 of FIG. 1. As discussed above, the bowl 110 portion of the pipe 100 may hold a combustible substance such as tobacco or cannabis that will be smoked in the pipe 100. In particular, such a substance may be held in the interior chamber 120 of the bowl 110. The combustible substance may be placed in the interior chamber 120 through the upper opening 130. A user using the pipe 100 to smoke such a substance may draw smoke from the pipe 100 at the stem opening 170, with the smoke flowing from the interior chamber 120 to the user through the interior airway 160 of the stem 150.

The upper opening 130 may be sized to allow access to combustible substance in the interior chamber 120 through the upper opening 130. For example, the upper opening 130 may be sized to allow a user to use a finger (or fingers) and/or a tool to access the interior chamber 120 therethrough. In some cases, the cross-sectional area of the upper opening 130 may be greater than the cross-sectional area of the lower opening 140.

As further described below, where the pipe 100 is used with a water pipe as mentioned above, smoke may be communicated to the water pipe through via lower opening 140. Accordingly, the lower opening 140 may be sized to allow sufficient gas to pass therethrough during such use and/or to allow the pipe 100 to interface with a particular size/configuration of water pipe.

In some cases, the pipe 100 may include features for avoiding or limiting the escape of combustible substances and/or ash escaping from the interior chamber 120 through the lower opening 140 such as, for example, during use.

For example, the cross-sectional area of the lower opening 140 may be selected to limit the escape of combustible substance and/or ash through it. For example, where the pipe 100 is used with cannabis, the cross-sectional area of the lower opening 140 may be selected to prevent or limit the escape of ground cannabis and/or cannabis ash (e.g., during use) through the lower opening 140. As mentioned above and as further described below, in some configurations of a pipe according to the subject matter of the present application, the interior chamber of the pipe may be in gaseous communication with the lower opening of the bowl by way of a shaft. It may be that the cross-sectional area of an opening of such a shaft (e.g., proximate to and/or connecting to the bowl 110) may be sized to limit the entry of the combustible substance into the shaft 410. For example, where such a pipe is used with cannabis, the cross-sectional area of the opening of the shaft may be selected to limit the escape of ground cannabis and/or cannabis ash therethrough. In a particular example, the area of the opening may be sized to limit the entry of ground cannabis and/or cannabis ash into the shaft.

In another example of avoiding/limiting the escape of combustible substances or combustion products thereof from the interior chamber 120, a screen may be employed to prevent/or limit material escaping from the interior chamber 120.

Figure 3:
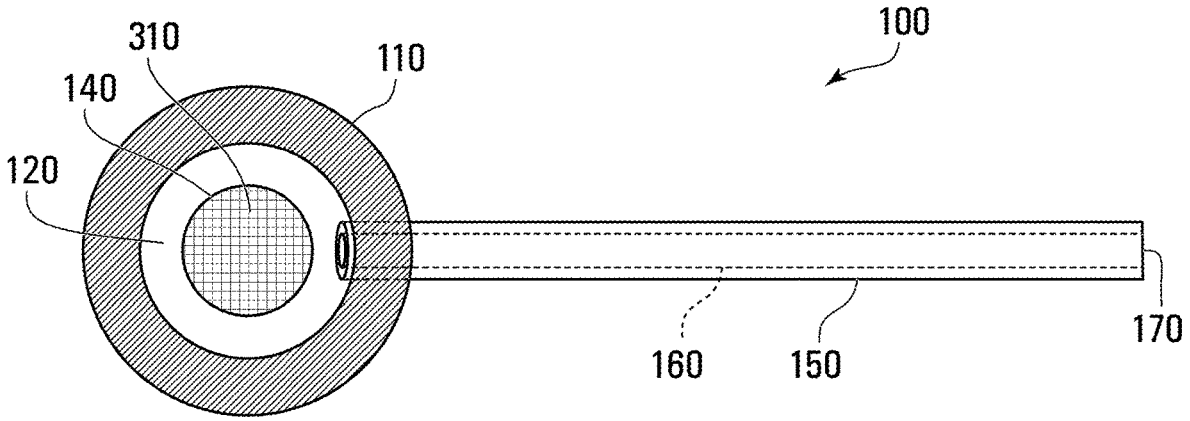
FIG. 3 is a cross-section view of another example configuration of the pipe in FIG. 1 taken along line 2-2 of FIG. 1.

An example of such a screen is shown in FIG. 3 which provides a cross-sectional view of another example configuration of the pipe 100 taken along the line 2-2 of FIG. 1. The pipe 100 as depicted in the example configuration of FIG. 3 includes a screen 310. As illustrated, the screen 310 is positioned in the lower opening 140 to limit the escape of material through the lower opening 140. More broadly, such a screen may be disposed proximate the lower opening 140 to limit escape of material through the lower opening 140. For example, a screen so disposed may limit the escape of ground cannabis and/or cannabis ash through the lower opening 140.

As mentioned above and as further described below, in some configurations of a pipe according to the subject matter of the present application, the interior chamber of the pipe may be in gaseous communication with the lower opening of the bowl by way of a shaft. In the case of such a pipe, a screen may, additionally or alternatively, be disposed in an opening of the shaft bordering the bowl 110. More broadly, a screen may be disposed proximate the opening of the shaft proximate the bowl to prevent and/or limit the incursion of combustible material and/or combustion products thereof through the lower opening of the bowl and/or incursion of such substances into the shaft.

In yet another example, more than one screen may be employed. For example, in pipes having a bowl with an interior chamber in gaseous communication with the lower opening thereof through a shaft, screens may be provided proximate the lower opening and proximate an opening into the shaft near the bowl. In a particular example, a screen may be provided covering both ends of the shaft.

Wherever disposed, screens included in the pipe 100 may be formed of material from which a mesh or grating may be formed. For example, screens may be or may include metal (e.g., steel) screening or plastic mesh/webbing. Notably, the selection of the material used in forming screens may be dependent on the positioning of a given screen, with materials selected to handle the expected thermal environment a screen in a given position can be expected to encounter during use. For example, a screen that will be positioned close to or within the interior chamber 120 may be formed of a material resilient against flames. Screens may be positioned/maintained in place within the pipe 100 by using various means, such as, for example, using an adhesive (e.g., glue), through mechanical engagement (e.g., by retaining the screen in a suitable channel in the bowl) and/or by way of one or more fasteners. Such positioning/retaining means may be selected to allow the screen to remain in place during use and transportation of the pipe. The screen may have a lattice structure with openings small enough to prevent or limit combustible substance, for example ground cannabis or ash, from falling through, but not so small as to hinder smoke from passing through. In some cases, a sandwich consisting of more than one mesh and/or webbing pieces may be employed as a screen.

As mentioned above, in some configurations of a pipe according to the subject matter of the present application, the interior chamber of the pipe may be in gaseous communication with the lower opening of the bowl by way of a shaft. An example of such a pipe is provided in FIG. 4.

Figure 4:
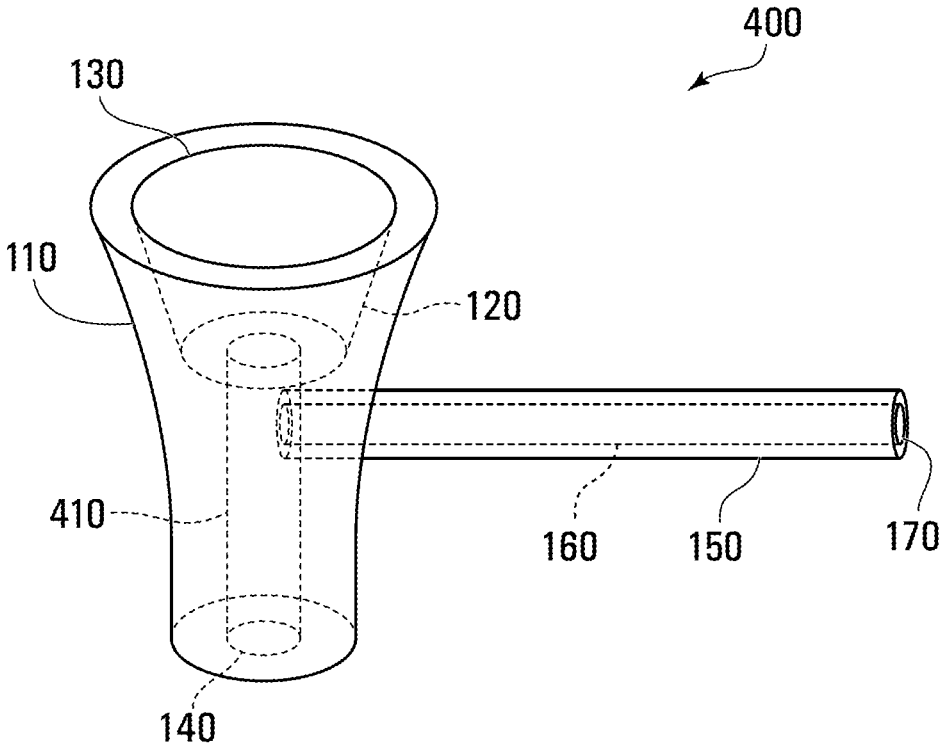
FIG. 4 is a perspective view of a second smoking pipe according to the subject matter of the present application.

FIG. 4 provides a perspective view of a second smoking pipe, namely a pipe 400. As illustrated, the pipe 400 is constructed with a shaft 410 extending between the interior chamber 120 and the lower opening 140. As shown, inclusion of the shaft 410 may vertically elongate the shape of the bowl 110. As further described below, a bowl so elongated may have a superior fit in the bowl-steam of a waterpipe when used therewith as compared to a bowl not so elongated (which may, for example, be a bowl not including a shaft and/or having a shorter shaft between its interior chamber and its lower opening).

As discussed above, one or more screens may be employed to reduce/limit the escape of substances from the bowl 110. For example, in the case of the pipe 400, such screens may be disposed in or near the lower opening 140 of the bowl 110 (i.e. at the base of the shaft) and/or in the opening of the shaft 410 near the bowl 110 (i.e. at the top of the shaft).

In some instances, pipes according to the present application may be sealed. More particularly, it may be that, as further described below, a pipe is provided according to the subject matter of the present application with one or more removable seals. So, sealing a pipe may provide one or more benefits. For example, in some cases, such pipes may be provided pre-loaded with a combustible material (e.g., cannabis) intended to be smoked using the pipe. Seals may act to maintain such a pre-loaded substance inside the pipe such as, for example, by preventing the combustible substance from falling out of the pipe. Further, sealing such a pre-loaded pipe may, additionally or alternatively, allow freshness of the pre-loaded combustible substance to be maintained such as, for example, by protecting that substance from light and/or air and/or humidity. In a particular example, the seals may hermetically seal the pipe. In summary, a pipe that is sealed may act both a storage vessel for combustible material stored therein and then, once partially or completely unsealed as further explained below, may also be used to consume the stored material via combustion. In another example, such seals may, additionally or alternatively, act to maintain cleanliness and/or sterility of the pipe—e.g. the interior of the pipe.

Figure 5:
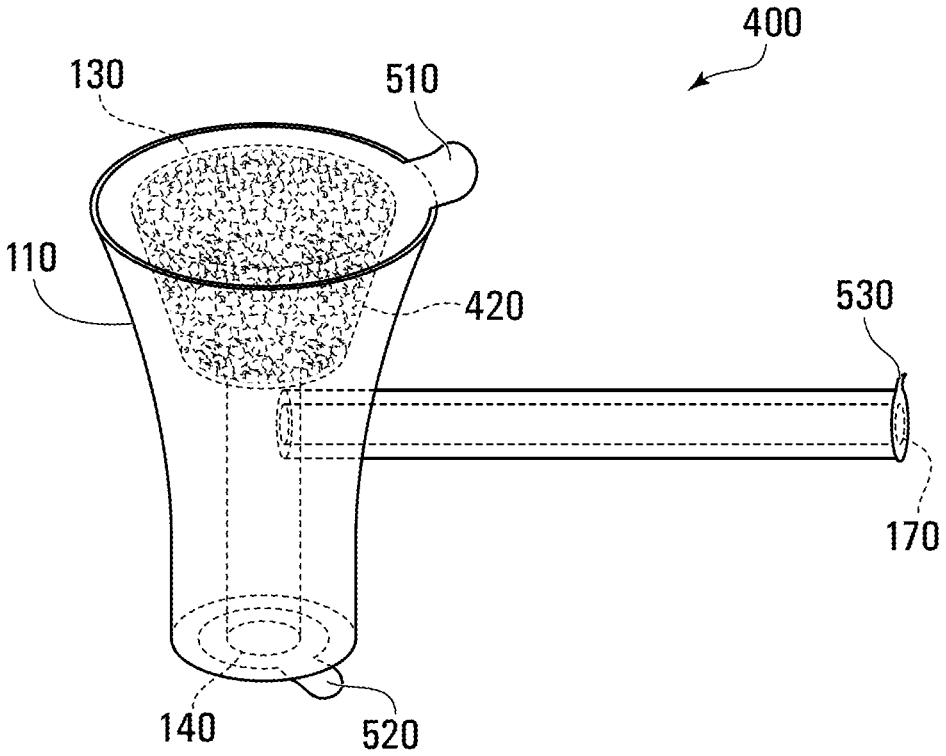
FIG. 5 is a perspective view of an example configuration of the pipe of FIG. 4 in a sealed state.

An example of a sealed pipe is provided in FIG. 5 which shows the pipe 400 in a sealed state.

As mentioned above, a quantity of combustible substance, may be placed in the interior chamber 120 of the bowl 110 of the pipe 400. For example, the pipe 400 has been pre-loaded with a quantity of cannabis 420 by placing the cannabis 420 in the interior chamber 120 of the bowl 110.

As illustrated, each of the openings in the pipe 400—namely, the upper opening 130, the lower opening 140, and the stem opening 170—has been closed off by a respective sealing element; namely, an upper opening sealing element 510, a lower opening sealing element 520, and a stem opening sealing element 530, respectively.

The various sealing elements may serve one or more purposes. For example, the each of the seals may seal the pipe 400 to ensure freshness of the cannabis 420. For example, each of the seals may prevent or limit outside elements such as, for example, gases like oxygen, reaching such pre-loaded material. Conveniently, limiting the incursion of such elements into the pipe 400 may prevent degradation of the pre-loaded material such as, for example, due to oxidation. In another example, the lower opening sealing element 520 may, additionally or alternatively, prevent or limit cannabis 420 through the lower opening 140. In yet another example, the upper opening sealing element 510 may act to maintain pre-loaded material inside the pipe 400 and, in particular, inside each the interior chamber 120 of the bowl 110.

Additionally or alternatively, the various sealing elements may, as further described below, serve to allow the pipe 400 to be easily used in different configurations. For example, as further described below, a user may remove some of the sealing elements while leaving others in place based on how the pipe is to be smoked. In a particular example, as further described below, some of the seals may be removed and maintained in order to use bowl 110 of the pipe 400 as the bowl of a waterpipe while others of the seals may be removed and maintained in order to smoke the pipe 400 without a waterpipe. The use of a sealed pipe is further described below with reference to FIGS. 6 and 7.

As discussed above, the pipe 400 is, as illustrated in FIG. 5, equipped with three seals, namely the upper opening sealing element 510, the lower opening sealing element 520, and the stem opening sealing element 530. However, it is contemplated that one or more of the upper opening 130, the lower opening 140, and the stem opening 170 may be unsealed. In other words, in some cases various combinations, of the openings may or may not be occluded by the sealing elements. For example, it may be that a non-pre-filled pipe is provided with a seal over one or both of the lower opening 140 and the stem opening 170. Such a pipe could, for example, be filled with a combustible substance (e.g., cannabis) and seals applied over the remaining openings (including the upper opening 130) thereby turning that pipe into a pre-loaded pipe.

The sealing elements may take a variety of forms. For example, the sealing elements may be removable or peelable seals. In a particular example, the sealing elements may be removable/peelable seals formed of one or more of metal foil, plastic film, rubber stopper, cork, and the like. More broadly, any type of seal suitable to a particular application may be utilized. For example, in order to maintain the freshness of the cannabis 420, oxygen-impermeable seals may be selected so as to prevent or limit oxidation of the cannabis 420.

The seals may also be applied to the pipe in a variety of manner. For example, seals may be affixed using an adhesive. In another example, the sealing elements may be induction seals and may be applied to the openings by way of an induction sealing process. In yet another example, seals such as, for example, a rubber, plastic, and/or cork seals may be mechanically fitted in openings such as, for example, by way of a displacement fit.

As mentioned above, the configuration of the pipe 400 depicted in FIG. 5 is pre-loaded with the cannabis 420. The cannabis 420 may take a variety of forms. For example, the cannabis 420 be or may include a cannabis derivative, such as, for example, resin or hash. Additionally or alternatively, the cannabis 420 may be or may include ground cannabis. The cannabis 420 may be an amount intended for a single smoking session. For example, the cannabis 420 may weigh between 0.25 and 0.5 grams. In a particular example, the cannabis 420 may weigh about 0.5 grams. The cannabis 420 may be low-THC cannabis such as, for example, a low-THC, high-Cannabidiol cannabis. A low-THC cannabis it may have a delta-9 tetrahydrocannabinol (THC) concentration of not more than 0.3% on a dry weight basis. Notably, using a low-THC cannabis in pre-loading the pipe 400 may allow the pipe 400 to be sold into jurisdictions that do not allow the sale of psychoactive cannabis.

As mentioned above, the pipe 400 could be provided by starting with a non-pre-loaded pipe without any seals. For example, the configuration of the pipe 400 depicted in in FIG. 4 or a configuration of the pipe 100 could serve as a starting point for producing a pre-loaded cannabis pipe. In any event, after providing such a pipe, a sealing element may be applied to the lower opening of the bowl of the pipe. A quantity of combustible material such as, for example, a quantity of one or more of the various forms of cannabis discussed above, is placed in the bowl of the pipe. Sealing elements may then be applied to the upper opening of the bowl of the pipe and to the opening of the airway in the stem of the pipe.

A skilled person having regard to the above will recognize that the above discussed ordering of steps for producing a pre-loaded pipe is by way of example and that various of the steps may be performed in differing orders. For example, in producing a pre-loaded pipe, the sealing elements could be applied in different orders relative to one another to the specific order just discussed.

Furthermore, in some cases, the process may include one or additional steps. For example, as part of the process of producing a pre-loaded cannabis pipe in such manners, the interior of the pipe 400 may be purged of oxygen. As an example of purging the interior of the pipe 400 of oxygen, it may be that when producing the pipe 400, after placing a quantity of cannabis 420 in the bowl 110 of the pipe 400 and before sealing all openings in the pipe, a gas other than oxygen is injected into the interior of the pipe 400. In other words, such a gas may be used to purge the pipe 400. For example, nitrogen or argon could be employed in such purging. Such purging may further help maintain freshness of the pre-loaded combustible material in a pipe, such as, for example, by excluding oxygen to prevent or limit oxidation of the cannabis 420 while it is stored inside the pipe 400.

As mentioned above, pipes according to the present application may be used and smoked in various configurations. Example of such uses and configurations will now be discussed with reference to FIGS. 5 and 6.

Figure 6:
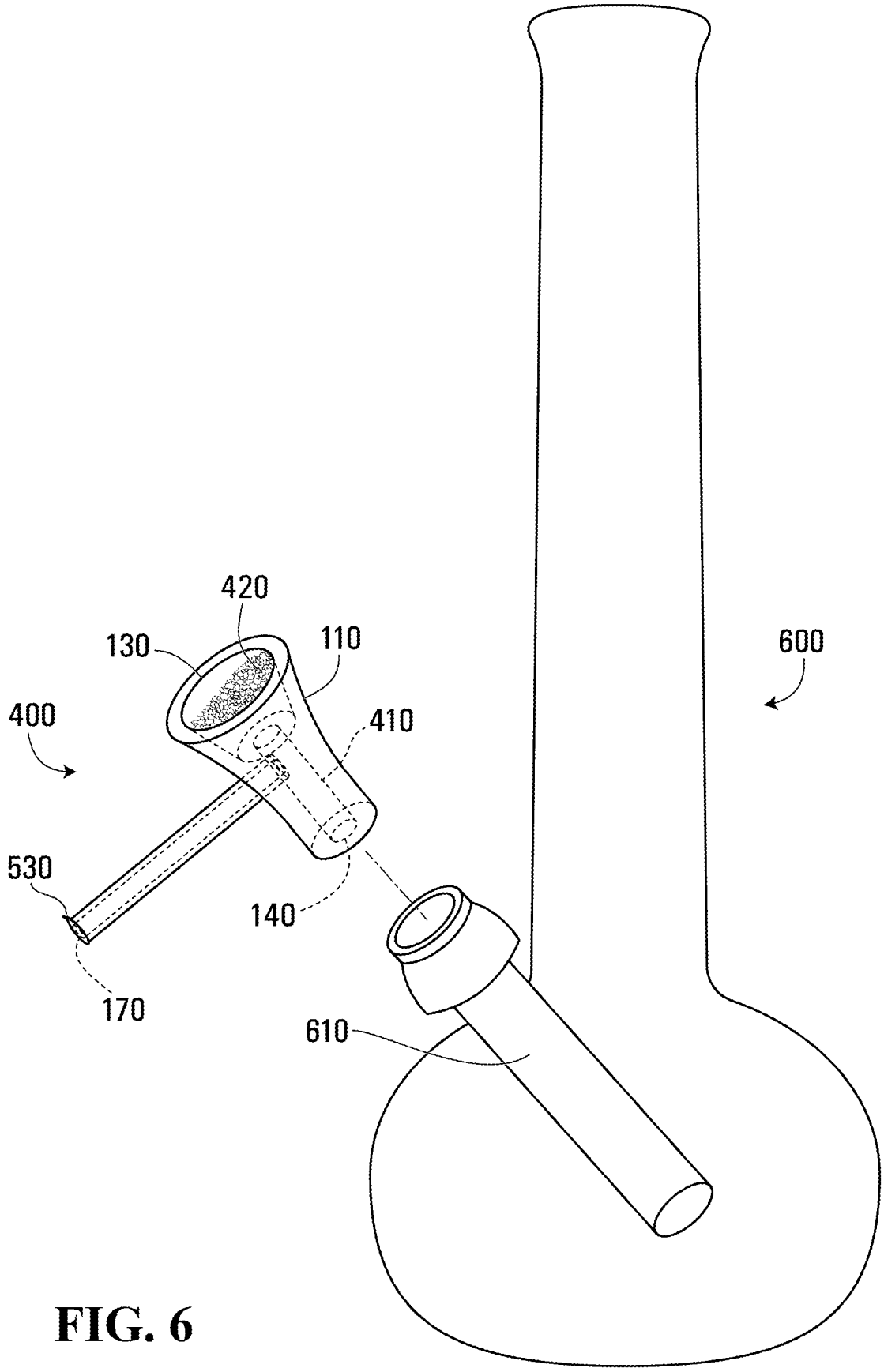
FIG. 6 is a perspective view of an example configuration of the pipe of FIG. 4 in use with a waterpipe.

FIG. 6 shows a perspective view of an example configuration of the pipe 400 where the pipe 400 is configured for use in a waterpipe 600. As in FIG. 5, the pipe 400 may have been pre-loaded with a quantity of cannabis 420. Additionally or alternatively, the user may place cannabis in the bowl 110 (i.e. the user may fill an empty bowl or top-up a pre-loaded quantity of cannabis).

As mentioned briefly above, seals may facilitate the use of the pipe 400 in the illustrated configuration. In particular, the stem opening sealing element 530 may present while the upper opening sealing element 510 and the lower opening sealing element 520 are absent. In particular, if the pipe 400 was provided with the upper opening sealing element 510 and the lower opening sealing element 520, the user may remove each from the upper opening 130 and the lower opening 140. Notably, the lower opening sealing element 520 should be removed before the pipe 400 is inserted into the waterpipe 600 as further described below.

After removing the upper opening sealing element 510 and the lower opening sealing element 520 (as applicable), the pipe 400 is placed in the waterpipe 600 with the bowl 110 fitting into a bowl-stem 610 of the waterpipe 600. Then, the combustible material in the bowl 110 (i.e., the cannabis 420) is heated (in some cases to ignition) such as, for example, by exposing it to a flame.

Notably, by having removed the upper opening sealing element 510 and the lower opening sealing element 520 (if present) thereby unblock the upper opening 130 and the lower opening 140, air is permitted to flow in, through, and out of the pipe 400 via those openings. In this way, smoke from combustible material burning and/or heating in the bowl 110 and, in particular, in the interior chamber 120, can carried from the pipe 400 into the waterpipe 600. Notably too, by maintaining the stem opening 170 occluded with the stem opening sealing element 530, the airway through the stem 150 is kept blocked off, and, in particular, smoke loss through the stem opening 170 is prevented or limited.

In some cases, however, a user may, intentionally or accidentally, remove the stem opening sealing element 530. Alternatively, it may be that the stem opening sealing element 530 is not provided with a given pipe. In such cases, a user may employ a pipe like the pipe 400 with a waterpipe by using their finger to block the stem opening 170 while drawing ("toking") on the pipe. Conveniently, such a manner of using the pipe 400 may allow the stem 150 to be used as carburetor to enhance combustion in the pipe 100 by allowing additional oxygen to flow to the interior chamber 120 through the interior airway 160 via the stem opening 170 while the stem opening 170 is unblocked.

As mentioned above, the bowl 110 of the pipe 400 is received in the bowl-stem 610 of the waterpipe 600. In some configurations, the bowl 110 may, as shown, be shaped to facilitate such insertion. More particularly, the bowl 110 may be shaped so that while the pipe 400 is inserted in the waterpipe 600 the lower opening 140 of the bowl 110 remains in gaseous communication with the airway of the bowl-stem to allow smoke to flow from the interior chamber 120 to the waterpipe 600. In order to so shape the bowl 110, an exterior sidewall of the bowl 110 may be tapered. For example, the lower portion of the bowl 110 may, as shown, be so tampered. In any event, such tampering may allow the bowl 110 to be received in a bowl-stem 610 that is also tapered (i.e., a tapered waterpipe bowl-stem). Additionally or alternatively, the bowl 110 may be substantially frustoconical in profile so as to allow it to be received in bowl-stems of varying sizes. More broadly, whether or not it is substantially frustoconical in profile, the bowl 110 may be sized and shaped so as to allow it be received in one or more sizes of bowl-stems. For example, the bowl 110 may be sized and shaped to interface with common sizes of bowl-stem fittings. In a particular example, the bowl 110 may be sized and/or shaped to allow it to interface with one or more of a 10-millimetre bowl-stem fitting, a 14-millimetre bowl-stem fitting, and an 18-millimetre bowl-stem fitting.

Figure 7:
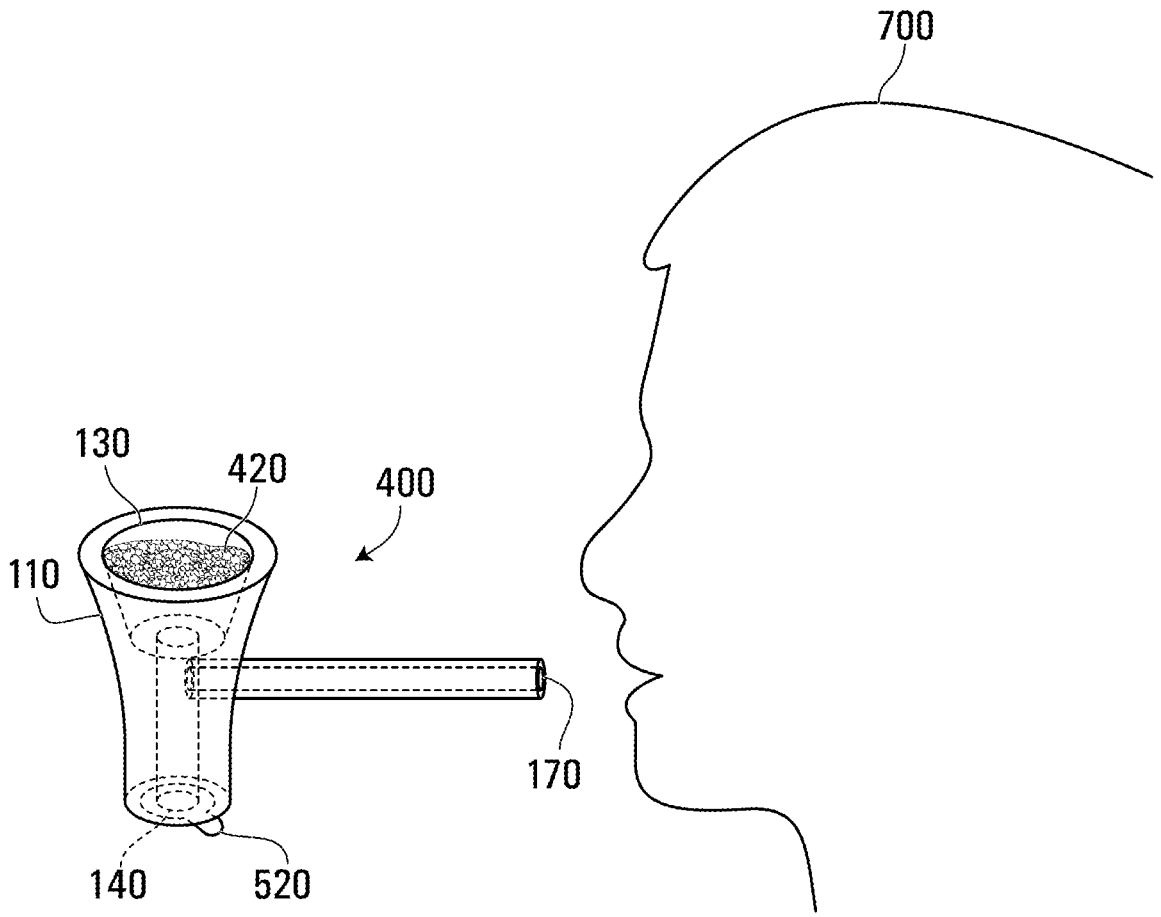
FIG. 7 is a perspective view of an example configuration of the pipe of FIG. 4 in use by a user.

A second example configuration for using and smoking the pipe 400 is provided in FIG. 7. FIG. 7 shows a perspective view of an example configuration of the smoking pipe in direct use by user 700. As discussed above, the pipe 400 may come pre-loaded with a quantity of cannabis 420. Additionally or alternatively, the user 700 may place cannabis 420 in the bowl 110 (i.e. the user may fill an empty bowl or top-up a pre-loaded quantity of cannabis).

In the configuration illustrated in FIG. 7, the lower opening sealing element 520 is present while the upper opening sealing element 510 and the stem opening sealing element 530 are not. For example, the user 700 may remove the upper opening sealing element 510 from the upper opening 130 and the stem opening sealing element 530 from the stem opening 170, if such sealing elements are present.

Once the seals have been so configured (i.e., with only the lower opening 140 sealed), the pipe 400 can be used directly by the user in manners similar to a standard smoking pipe. For example, the cannabis 420 can be heated (in some cases to ignition) such as, for example, by exposing it to a flame. Notably, the absence of the upper opening sealing element 510 and the stem opening sealing element 530 will allow air to flow into the interior chamber 120 through the upper opening 130. Accordingly, during smoking as a user draws on the pipe through the stem opening 170 with their mouth, air so drawn may then, carry smoke through the interior airway 160 and out through the stem opening 170 into the mouth of the user. Meanwhile, by leaving the lower opening 140 occluded with the lower opening sealing element 520, the pathway through the lower opening 140 is closed, thereby preventing or limiting smoke loss and/or the escape of ground cannabis or ash through the lower opening 140.

A pipe having openings as described above (i.e., the upper opening 130, the lower opening 140 and the stem opening 170) may be formed in a variety of manners. An example manner of forming such a pipe will now be discussed below with reference to FIG. 8.

Figure 8:
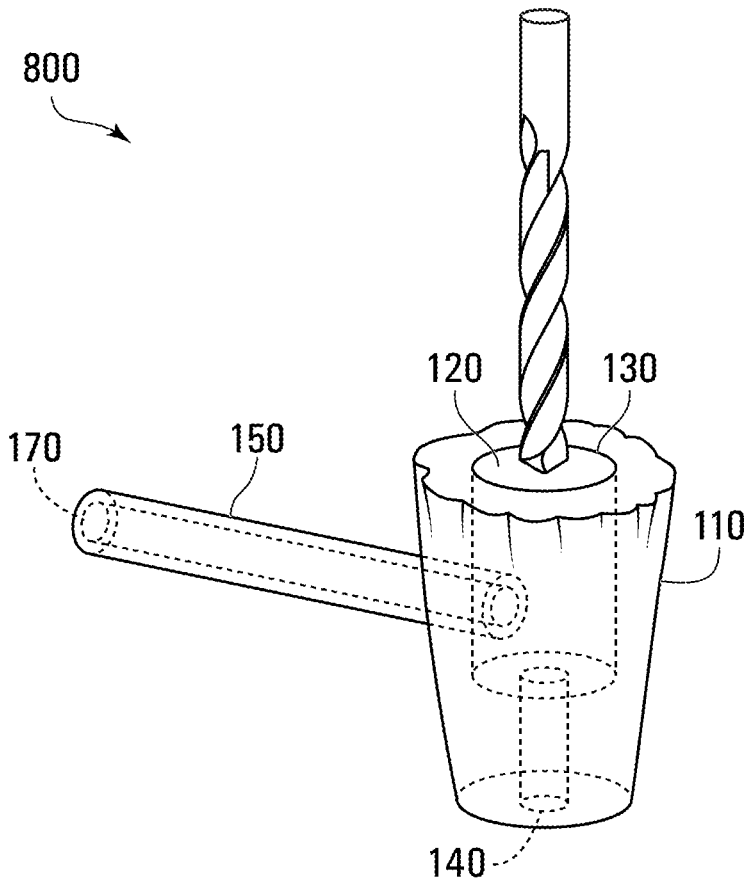
FIG. 8 is a perspective view of an example corncob pipe being prepared for use as a pre-loaded cannabis pipe.

FIG. 8 provides a perspective view of another example pipe, namely an example pipe 800. As illustrated, the example pipe 800 is a corncob pipe.

The example pipe 800 is depicted during the process of being prepared for use as a pre-loaded pipe. Firstly, the example pipe 800, is provided. As mentioned above, in the illustrated example, the example pipe 800 is a common corncob pipe. The example pipe 800 has a bowl 110 and a stem 150. As shown, a shaft will be created in a lower portion of an interior chamber 120 of the bowl 110. Such shaft may be formed in the example pipe 800 using any suitable means, such as, for example, using a drill as shown and/or by other means such as, for example, by chiseling. The shaft will extend through the base of the bowl 110. Notably, once the shaft has been formed, the resulting pipe may have an interior configuration akin to that of the pipe 400—i.e., with a newly-formed shaft (shown in stippled lines) extending between the interior chamber 120 and a newly-formed lower opening 140 (also shown in stippled lines). Once the shaft is formed, a sealing element (not shown) may be applied to cover the lower opening defined by the shaft in the base of the bowl 110. A combustible material (not shown) such as, for example, a quantity of some form of cannabis, may be placed in the bowl 110 of the example pipe 800. Sealing elements (not shown) may also be applied to one or both of the upper opening 130 (i.e., the opening defined by the interior chamber 120 of the bowl 110), and the stem opening 170 of the stem 150 of the example pipe 800. Finally, similar to was described previously in relation to FIG. 6, the bowl 110 of the example pipe 800 may be shaped (not shown) to allow the example pipe 800 to be received in a bowl-stem of a waterpipe with the bowl 110 of the example pipe 800 in gaseous communication with an airway of the bowl-stem via the lower opening 140 of the bowl 110. For example, the bowl 110 may be shaped by sanding and/or chiseling.

A skilled person having regard to the above will recognize that the above discussed ordering of steps for producing a pre-loaded corncob cannabis pipe is by way of example and that various of the steps may be performed in differing orders. For example, the sealing elements may be applied in different orders relative to one another. Some steps may, however, have interdependencies in order to arrive at the intended resulting object. For example, cannabis may only be placed in the bowl 110 after the shaft is formed to prevent damage to the cannabis during forming of the shaft.

A pre-loaded corncob pipe may be purged in manners akin to those as were discussed above with reference to the pipe 400. Similarly, it is noted that where the combustible material used to load a pre-loaded corncob pipe is cannabis (i.e., where a pre-loaded corncob cannabis pipe is being formed and produced), the cannabis may include cannabis of varying quantities and types (e.g., cannabis derivatives, different THC content) such as was, for example, discussed above with reference to the cannabis 420 and the pipe 400.

Figure 9:
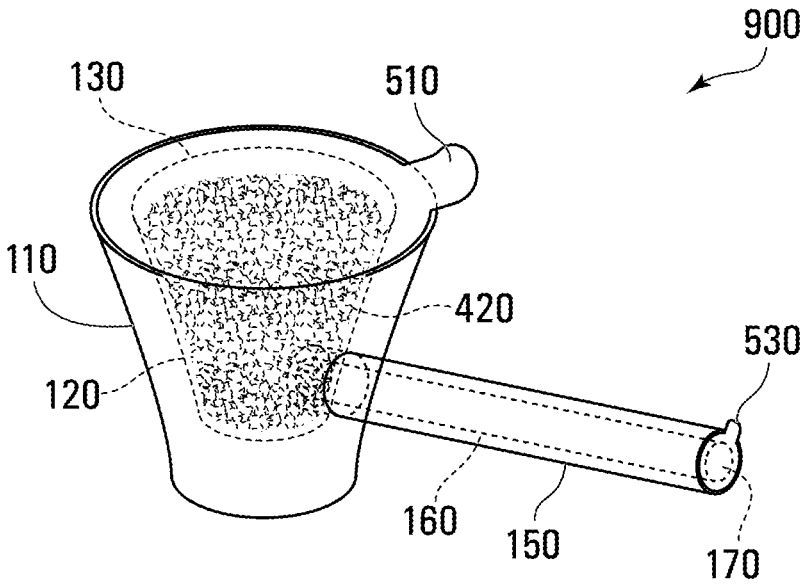
FIG. 9 is a perspective view of a pre-loaded, sealed cannabis pipe according to the subject matter of the present application.

Another example of a pre-loaded pipe will now be discussed with reference with FIG. 9. FIG. 9 depicts a pre-loaded, sealed cannabis pipe, namely a pipe 900. The pipe 900 differs from the pipes discussed above insofar as it is a pre-loaded pipe allowing direct use by a user, but not including a lower opening and other features to allow use as a bowl of a waterpipe. Accordingly, the pipe 900 omits the both a lower bowl opening and, consequently, also does not include a lower opening sealing element. However, akin to the other example pipes discussed above, the pipe 900 includes a bowl 110 for holding a quantity of cannabis 420 and a stem 150 from which a user draws in smoke. The bowl 110 of the pipe 900 defines an interior chamber 120 having an upper opening 130. The stem 150 extends from the bowl 110 and defines an interior airway 160 with a stem opening 170 located on or near a distal end of the stem. The interior airway 160 is in gaseous communication with the interior chamber 120 of the bowl 110 to provide a pathway allowing air to carry smoke from the bowl 110 to the mouth of a user during smoking. The interior airway 160 may be in gaseous communication with the interior chamber 120 by way of a direct connection therebetween or by way of an indirect connection such as, for example, by way of a shaft extending therebetween. Each of the upper opening 130 and the stem opening 170 are sealed using seals akin to those discussed above. In particular, as illustrated, an upper opening sealing element 510 occludes the upper opening 130 and a stem opening sealing element 530 occludes the stem opening 170, respectively.

Various of the considerations and features described previously with respect to FIGS. 1-5 may be applied apply to the pipe 900. For example, the same considerations may apply in selecting a material or materials from which to form the pipe 900 as with the pipe 100. As such, the pipe 900 may, for example, be formed of one or more of: briarwood, clay, ceramic, corncob, glass, meerschaum, metal, gourd, stone, and wood. In another example, one or both of the bowl 110 and stem 150 may, additionally or alternatively, be formed out of wood, such as, for example, pear-wood, rose-wood, cherry, olive, maple, mesquite, oak, bog-wood and briarwood. In particular example, the bowl 110 may be formed of corncob. As such, the pipe 900 may be a corncob pipe. Additionally or alternatively, the stem 150 may be formed of wood. In another example, one or both the bowl 110 and stem 150 of the pipe 900 may be formed of briarwood.

The pipe 900 may be pre-loaded with a combustible material. For example, as shown, the pipe 900 may be pre-loaded with a quantity of cannabis 420 placed in its bowl 110. As discussed above, various forms and quantities of cannabis may be employed including, for example, cannabis derivatives. For example, the cannabis 420 may be resin or hash. Additionally or alternatively, the cannabis 420 may be ground cannabis. The cannabis may weigh between 0.25-0.5 grams, and furthermore may have a THC concentration of not more than 0.3% on a dry weight basis.

As mentioned above, the various sealing elements of the pipe 900 may be akin to those discussed above. Accordingly, the seals may have similar features and characteristics to those discussed above. For example, the sealing elements may be removable or peelable seals and/or may be formed of one or more of metal foil, plastic film, rubber stopper, cork, and the like. Additionally or alternatively, the seals may be removable, induction seals. In order to maintain the freshness of the cannabis 420, oxygen-impermeable seals may be selected so as to prevent or limit oxidation of the cannabis 420. Purging may also be employed as discussed above. Notably, in the pipe 900 both of the openings (i.e. the upper opening 130 and the stem opening 170) are sealed in order to maintain freshness of the pre-loaded cannabis 420 and/or to maintain the cannabis 420 inside the pipe 900 prior to use.

The pipe 900 may be produced by starting from a standard pipe. Such a pipe may have a bowl 110 and stem 150 extending from the bowl as discussed above. Further, as discussed, the stem 150 may have an opening 170 on or about the end further the bowl (i.e., an opening proximate the distal end of the stem). As part of the process of producing the pipe 900, a quantity of cannabis 420 may be placed in in the bowl 110 of the pipe 900. Then openings in the pipe may be sealed. For example, sealing elements may be applied to the upper opening 130 of the bowl 110 of the pipe 900 and to the stem opening 170 of the stem 150 of the pipe 900 (i.e., the upper opening sealing element 510 and the stem opening sealing element 530.)

As mentioned above, as a part of producing the pipe 900, the pipe 900 may be purged of oxygen such example, for example, by injecting a gas other than oxygen into the interior of the pipe 900 in manners akin to those discussed above. As discussed above, a gas such as nitrogen or argon may be employed in such purging. Oxygen purging may further help maintain freshness of the cannabis 420.

The use of the pipe 900 is similar to the use of the pipe 100 discussed previously in relation to FIG. 7: to ready the pipe 900 for use a user removes the upper opening sealing element 510 from the upper opening 130 and the stem opening sealing element 530 from the stem opening 170, before smoke the pipe. Smoking the pipe may include heating the cannabis 420. Heating the cannabis 420 may include heating it, potentially to ignition, such as, for example, by exposing it to a flame as discussed above.

The pipes discussed above are example embodiments and are capable of variation without deviating from the subject matter of the present application.

It is noted, for example, that the sealed configurations of the pipe 400 of FIG. 5 and the pipe 900 of FIG. 9 both, as discussed above, act as both a storage vessel and a vessel for consuming stored combustible material via combustion.

As an example of possible variation, other vessels providing such dual functionality may be provided without deviating from the subject matter of the present application. For example, pre-loaded sealed vessels of other configurations such as, for example, pre-loaded sealed pipes and/or pre-loaded sealed bowls of various shapes and designs, may be provided.

In a particular example, akin to the various pipes discussed above, a vessel that may act as both a storage vessel and a vessel for consuming stored combustible material via combustion may include a body that defines an interior chamber. The vessel may also have one or more openings in communication (e.g., in gaseous communication) with the interior chamber. One or more sealing elements (e.g., removable seals) may be provided sealing those opening(s). The seals may maintain pre-loaded combustible material inside the vessel (e.g., in the interior chamber) in advance of later consumption, thereby allowing the vessel to act as a storage vessel for that combustible material. Some or all of the sealing elements may be removable. The openings may be configured to allow the combustible material pre-loaded into and disposed in the vessel to be consumed by a user by combusting that material in the vessel (e.g., within the interior chamber). Various or all of the removable sealing elements may be removed to place the vessel into one of one or more configurations where at least some of the openings are unobstructed and the vessel may be used to so consume the combustible material via combustion (including, potentially, via heating, possibly to ignition) in one or more manners. For example, such a vessel may allow consumption in a "pipe-like" manner and/or in the manner of a bowl for a water pipe as discussed above.

In the present application, the term "and/or" is intended to cover all possible combinations and sub-combinations of the listed elements, including any one of the listed elements alone, any sub-combination, or all of the elements, and without necessarily excluding additional elements.

In the present application, the phrase "at least one of . . . or . . . " is intended to cover any one or more of the listed elements, including any one of the listed elements alone, any sub-combination, or all of the elements, without necessarily excluding any additional elements, and without necessarily requiring all of the elements.

As noted, certain adaptations and modifications of the described embodiments can be made. Therefore, the above-discussed embodiments are considered to be illustrative and not restrictive.

What is claimed is:

1. A pipe comprising:

a bowl defining an interior chamber with an upper opening and a lower opening; and a stem extending laterally from the bowl at a side of the bowl to form a pipe-shape together with the bowl, the side being located between the upper opening and the lower opening of the bowl, the stem defining an interior airway with an opening proximate a distal end of the stem, wherein an opening of the stem proximate the interior chamber is positioned at the side of the bowl between the upper opening of the bowl and the lower opening of the bowl;

a quantity of combustible material disposed within the interior chamber of the bowl; and a first removable sealing element occluding the upper opening of the bowl;

a second removable sealing element occluding the opening proximate the distal end of the stem; and a third removable sealing element occluding the lower opening.

2. The pipe of claim 1, further comprising a shaft extending from the interior chamber of the bowl, wherein the interior airway is in gaseous communication with the interior chamber via said shaft.

3. The pipe of claim 2, wherein the combustible material is cannabis, and wherein a cross-sectional area of an opening of the shaft extending from the interior chamber of the bowl is sized to limit entry of at least one of ground cannabis or cannabis ash into the shaft.

4. The pipe of claim 2, wherein the combustible material is cannabis, the pipe further comprising at least one screen disposed proximate an opening of the shaft extending from the interior chamber of the bowl to limit escape of at least one of ground cannabis or cannabis ash through the opening of the shaft.

5. The pipe of claim 1, wherein the first, second and third removable seals are induction seals.

6. The pipe of claim 1, wherein the combustible material is cannabis, ground cannabis, or a cannabis derivative.

7. The pipe of claim 6, wherein the cannabis weighs between 0.25 and 0.5 grams.

8. The pipe of claim 7, wherein the cannabis has a delta-9 tetrahydrocannabinol (THC) concentration of not more than 0.3 percent on a dry weight basis.

9. The pipe of claim 1, wherein the pipe is shaped to allow the pipe to be received in bowl-stems of waterpipes.

10. A method of producing a pre-loaded cannabis pipe comprising:

providing a pipe having a bowl and a stem extending laterally from the bowl at a side of the bowl to form a pipe-shape together with the bowl, the side being located between an upper opening and a lower opening of the bowl, the bowl defining an interior chamber with the upper opening and the lower opening, and the stem defining an interior airway with an opening proximate a distal end of the stem, wherein an opening of the stem proximate the interior chamber is positioned at the side of the bowl between the upper opening of the bowl and the lower opening of the bowl;

placing a quantity of cannabis in the bowl of the pipe;

applying a first sealing element to the upper opening of the bowl;

applying a second sealing element to the lower opening of the bowl; and applying a third sealing element to the opening proximate the distal end of the stem.

11. The method of claim 10, wherein the interior airway of the stem is in gaseous communication with the interior chamber of the bowl via a shaft extending from the interior chamber of the bowl.

12. The method of claim 10, further comprising injecting at least one gas other than oxygen into the interior of the pipe before applying at least one of the sealing element to the upper opening of the bowl and the sealing element to the opening proximate the distal end of the stem.

13. The method of claim 12, wherein the at least one gas other than oxygen includes nitrogen.

14. The method of claim 10, wherein the cannabis is ground cannabis or a cannabis derivative.

15. The method of claim 10, wherein the cannabis weighs between 0.25 and 0.5 grams.

16. The method of claim 10, wherein the cannabis has a delta-9 tetrahydrocannabinol (THC) concentration of not more than 0.3 percent on a dry weight basis.

17. The method of claim 10, wherein the pipe is shaped to allow the pipe to be received in bowl-stems of waterpipes.

* * * * *